US007086730B2

(12) United States Patent
Aoki

(10) Patent No.: US 7,086,730 B2
(45) Date of Patent: Aug. 8, 2006

(54) INK-JET PRINTER AND STAR ROLLER USED THEREIN

(75) Inventor: Ryuji Aoki, Daito (JP)

(73) Assignee: Funai Electric Co., Ltd., Daito (JP)

( * ) Notice: Subject to any disclaimer, the term of this patent is extended or adjusted under 35 U.S.C. 154(b) by 82 days.

(21) Appl. No.: 10/950,641

(22) Filed: Sep. 28, 2004

(65) Prior Publication Data

US 2005/0068401 A1 Mar. 31, 2005

(30) Foreign Application Priority Data

Sep. 29, 2003 (JP) ..... 2003-337393

(51) Int. Cl.
*B65H 3/06* (2006.01)

(52) U.S. Cl. ..... 347/104; 271/109; 492/33; 492/40

(58) Field of Classification Search ..... None
See application file for complete search history.

(56) References Cited

U.S. PATENT DOCUMENTS 6,666,449 B1 * 12/2003 DeFosse et al. ..... 271/187
6,843,762 B1 * 1/2005 Munche et al. ..... 492/40

FOREIGN PATENT DOCUMENTS

| | | | |
|---|---|---|---|
| JP | 10-330005 | | 12/1998 |
| JP | 2001-080805 | | 3/2001 |
| JP | 2002241008 A | * | 8/2002 |
| JP | 2003-145358 | | 5/2003 |

* cited by examiner

*Primary Examiner*—Andrew H. Hirshfeld
*Assistant Examiner*—Jill E. Culler
(74) *Attorney, Agent, or Firm*—Crowell & Moring LLP

(57) ABSTRACT

A star roller used in a paper feed mechanism of an ink-jet printer is constituted by a combination of two star roller units having the same shape in a manner so that one star roller unit is reversed with respect to the other star roller unit. Each star roller unit has a star wheel made of a metal plate by press working, a bearing portion integrally formed with the star wheel by outsert molding and a convex and concave structure formed on an end face of the bearing portion in a manner so that the concave portions of the convex and concave structure of the one star roller unit is engaged with the convex portions the convex and concave structure of the other star roller unit. Consequently, the pitch of the contacting portions of the star roller owing to two star wheels can be made substantially half, and a thickness of each contacting portion can be made thinner, and a top end of each contacting portion can be shaped acute.

7 Claims, 4 Drawing Sheets

INK-JET PRINTER AND STAR ROLLER USED THEREIN

BACKGROUND OF THE INVENTION

1. Field of the Invention

The present invention relates to an ink-jet printer, and especially relates to a star roller used in a paper feed mechanism of the ink-jet printer.

2. Description of the Related Art

In a paper feed mechanism of an ink-jet printer, a roller called a "star roller" is used for conveying a paper sheet in a portion where ink applied on a surface of the paper sheet has not been dried. Since the star roller contacts the surface of the paper sheet, there is a possibility that the ink applied on the surface of the paper sheet is re-transcribed onto a surface of the star roller. Thus, the star roller has a star wheel in which a plurality of contacting portions protrude in radial directions at a predetermined pitch so as to decrease a dimension of each contacting portion. In order to decrease the dimension of each contacting portion of the star wheel to be as small as possible, the thickness of the star wheel in axial direction of rotation of the star roller should be made as thin as possible, and that the top end of each contacting portion should be made as acute as possible.

On the other hand, since the contacting portion of the star wheel is formed at the predetermined pitch, a load of a delivery roller, which is provided for facing the star roller with the paper sheet intervening, is largely varied between a condition that a contacting portion of the star wheel contacts the surface of the paper sheet and another condition that no contacting portion of the star wheel contacts the surface of the paper sheet. Thus, vibrations occur in the paper sheet. When a magnitude of the vibrations becomes larger, conveying speed of the paper sheet facing at an image forming portion facing an ink-jet head also varies, so that quality of the image formed on the paper sheet will be deteriorated. In order to prevent the deterioration of the image quality, it is desirable to make the pitch of the contacting portions of the star wheel as small as possible.

As a manufacturing method of the star roller, a resin molding can be used so that a star wheel and a bearing portion are integrally formed of resin. Alternatively, an outsert molding can be used so that a star wheel made of a metal plate by press working and a bearing portion made of resin are integrally fixed.

Publication Gazette of Japanese Patent Application 10-330005 shows a first conventional star roller in which a star wheel and a bearing portion are integrally formed by resin molding, and the pitch of contacting portions of the star wheel is made smaller. Specifically, a first recess for a first star wheel portion and a half of the bearing portion is formed on, for example, a movable portion of a die, and a second recess for a second star wheel portion and the rest of the bearing portion is formed on a stationary portion of the die. The second recess is formed in a manner so that the pitch of contacting portions of the second star wheel is discrepant by a half pitch with respect to the pitch of contacting portions of the first wheel when the movable portion and the stationary portion of the die are engaged with each other. Melted resin is injected into the recesses of the die, so that the star roller is formed when the resin is solidified. Such a star roller is equivalent to a hypothetical star roller having contacting portions of a star wheel at a half pitch.

Publication Gazette of Japanese Patent Application 2001-80805 shows a second conventional star roller in which two star wheels made of a metal plate by press working are integrally fixed with bearing portion by outsert molding.

In a comparison between the first conventional star roller and the second conventional star roller, the first conventional star roller has an advantage, in that the cost for manufacturing the first conventional star roller is relatively lower than that of the second conventional star roller, since the first conventional star roller is integrally formed by resin molding. The first conventional star roller, however, has as a disadvantage that a thickness of the contacting portion in an axial direction of rotation of the first conventional star roller is thicker than that of the second conventional star roller. Furthermore, a shape of a top end of each contacting portion of the first conventional star roller is affected by flow property of the resin, so that an angle of the top end of the contacting portion in tangential direction of the first conventional star roller becomes a little obtuse than that of the second conventional star roller. Thus, when the first conventional star roller is used in a paper feed mechanism of an ink-jet printer and when ink applied on a surface of a paper sheet has not been dried, the ink could be spread on the surface of the paper sheet due to the contacting portion of the star wheel, or an ink blot could occur due to reattachment of the ink on the contacting portion of the star wheel to another portion on the surface of the paper sheet.

On the other hand, the second conventional star roller has the advantage that the thickness of the contacting portion in the axial direction can be made thinner and the angle of the top end of the contacting portion in tangential direction can be shaped acute than those of the first conventional star roller. The second conventional star roller, however, has a disadvantage that a cost of a die for outsert molding becomes higher, since the die for outsert molding needs a slide core and a mechanism for moving the slide core. Furthermore, the recesses for forming the star rollers must be aligned on only one line in the die, in order to mold a plurality of the star rollers in the same die in one molding operation. Thus, a number of the star rollers molded in one molding operation of the die cannot be increased. As a result, a unit cost of each star roller becomes higher.

Publication Gazette of Japanese Patent Application 2003-145356 shows a conventional method for forming a star wheel by press working. According to the conventional method, a metal plate is preliminary punched out, and contacting portions are shaped using a punch and a die for shear working. Subsequently, the contact portions are made thin and acute by electrolytic polishing. Since the conventional method for forming the star wheel needs many processes, a unit cost of the star wheel becomes higher. Furthermore, a unit const of a hypothetical star roller using the star wheel made of the conventional method in the above-mentioned second conventional star roller becomes much higher, even though the star roller has thin and acute contacting portions.

SUMMARY OF THE INVENTION

A purpose of the present invention is to provide an ink-jet printer using a star roller in a paper feed mechanism, in which vibrations of the paper sheets due to contacting and non contacting of the star roller can be reduced so that the quality of an image formed on a surface of a paper sheet is rarely damaged, and reattachment or blot of ink due to the star roller contacting a portion on the surface of the paper sheet where the ink has not been dried can be prevented. Another purpose of the present invention is to provide a low cost star roller used in an inkjet printer in which a pitch of contacting portions of a star wheel are substantially made smaller, a thickness of the contacting portion in axial direction of the star roller is thinner, and an angle of a top end of the contacting portion in a tangential direction of the star wheel is acute. Still another purpose of the present invention is to provide a star roller unit, which constitutes the star roller.

An ink-jet printer in accordance with an aspect of the present invention comprises paper feed tray, a paper feed mechanism for conveying a paper sheet in a predetermined paper feeding direction, a carriage provided for facing a predetermined position in the paper feed mechanism and reciprocally movable in a main scanning direction perpendicular to the paper feeding direction, a carriage driving mechanism for moving the carriage reciprocally in the main scanning direction, an ink-jet head held on the carriage, and a controller for controlling the paper feed mechanism, the carriage driving mechanism, and the ink-jet head for forming an image on a surface of the paper sheet using image data.

The paper feed mechanism further comprises a delivery roller and a plurality of star rollers facing the delivery roller and being rotated by following the rotation of the delivery roller when the paper sheet intervenes between them, the delivery roller and the plurality of star rollers being provided at a downstream position from an image forming portion facing the ink-jet head in the paper feeding direction.

The star roller is constituted by a combination of two star roller units having the same shape.

Each star roller unit comprises: one star wheel made of a metal plate by press working, in which a plurality of contacting portions are provided in a radial pattern at a predetermined angular pitch; a bearing portion integrally formed with the star wheel by an outsert molding; and a convex and concave structure formed on at least an end face of the bearing portion in which a plurality of convex portions have the same pitch and phase as those of the contacting portions of the star wheel, and in which a plurality of concave portions have the same pitch as that of the contacting portions of the star wheel and a phase discrepant by half with respect to the phase of the convex portions so that the convex portions can be engaged with the concave portions.

According to the above-mentioned configuration, the star roller is constituted by the combination of two star roller units having the same shape in a manner so that the pitch of contacting portions of the star wheel of one star roller unit is discrepant by a half pitch with respect to that of the other star roller unit. Thus, the star roller is equivalent to having a single star wheel in which the contacting portions are provided at a half pitch. Consequently, the vibrations of the paper sheet due to contact and non-contact of the contacting portions of the star roller can be reduced, so that a reduction of the quality of the image formed on the paper sheet can be prevented.

Furthermore, the star wheel can be formed of a metal plate by press working, so that the thickness of the contacting portions in the axial direction of the rotation of the star roller can be made thinner, and the top end of the contacting portions in the tangential direction of the star roller can be shaped acute. Thus, the dimension of each contacting portion of the star roller can be made smaller. Consequently, it is possible to decrease the possibility of the occurrence of the ink blot due to reattachment of the ink attached on the contacting portion of the star wheel at another portion on the surface of the paper sheet, even when the ink applied on the paper sheet has not been dried.

Still furthermore, only one star wheel is outserted in each star roller unit, so that it is not needed to use the slide core in the die for molding the star roller unit. Thus, the number of star roller units molded in the same die in one molding operation can be increased drastically. Consequently, the unit costs of the star roller unit and the star roller can be decreased drastically. Still furthermore, the cost of the ink-jet printer, which uses a plurality of star rollers, can be decreased.

DETAILED DESCRIPTION OF THE EMBODIMENT

An ink-jet printer, a star roller used therein, and a star roller unit in accordance with an embodiment of the present invention are described.

Figure 1:
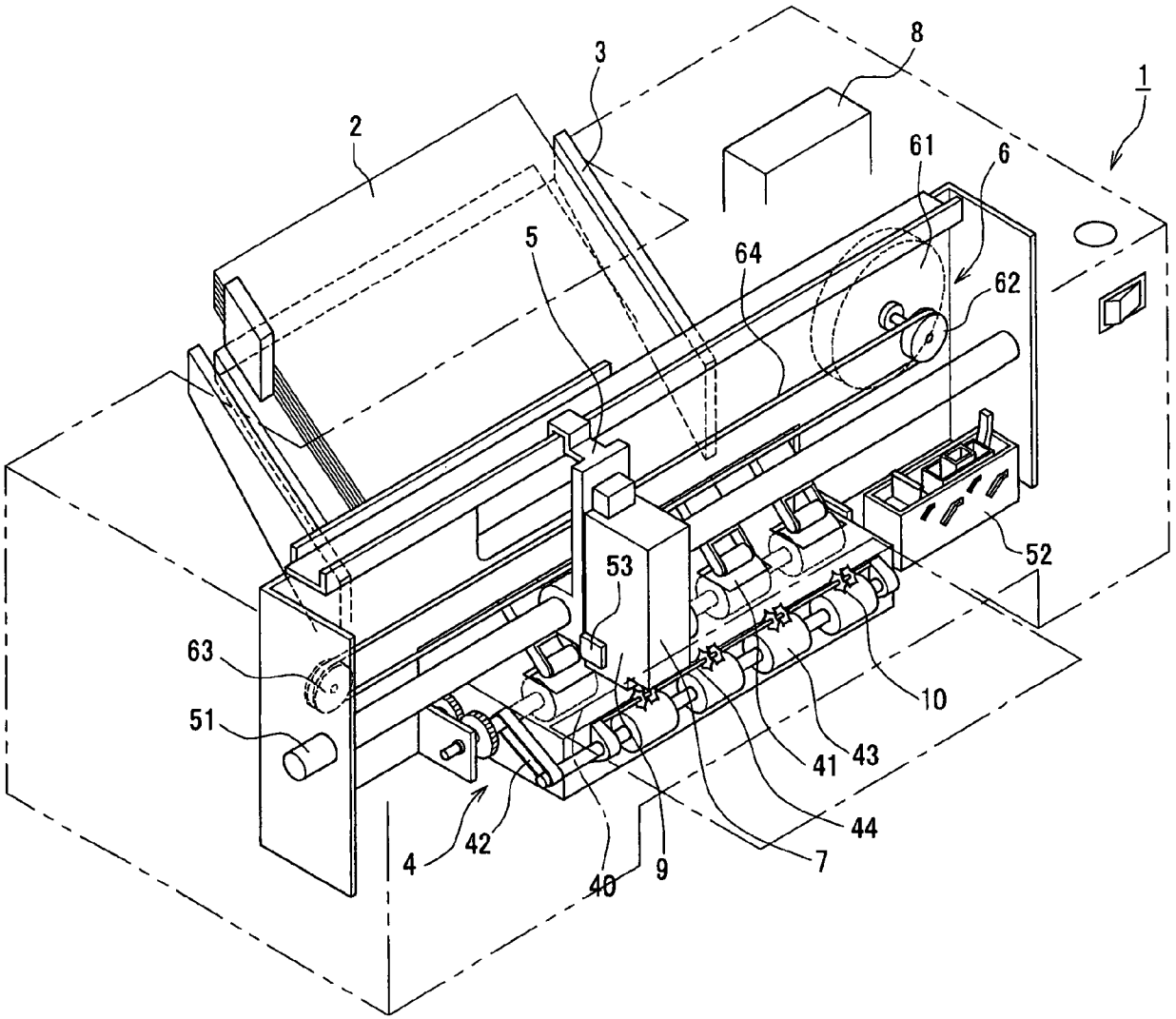
FIG. 1 is a perspective view showing a configuration of an ink-jet printer in accordance with an embodiment of the present invention.

FIG. 1 shows a configuration of the ink-jet printer 1 in accordance with the embodiment. The ink-jet printer 1 comprises a paper feed tray 3 on which paper sheets 2 are stacked, a paper feed mechanism 4 for conveying the paper sheet 2 in a predetermined paper feeding direction (sub-scanning direction), a carriage 5 provided for facing a predetermined position in the paper feed mechanism 4 and reciprocally movable in a main scanning direction perpendicular to the paper feeding direction, a carriage driving mechanism 6 for moving the carriage 5 reciprocally in the main scanning direction, an ink cartridge 7 mounted on the carriage 5 and including an ink-jet head 9, and a controller 8 for controlling the paper feed mechanism 4, the carriage driving mechanism 6, and the ink-jet head 9 for forming an image on a surface of the paper sheet 2 using image data.

The paper feed mechanism 4 is constituted by a driving roller 41 which is rotated by a motor (not shown), a belt 42, a delivery roller 43 coupled with the driving roller 41 via the belt 42 so as to be rotated in synchronism with the rotation of the driving roller 41, and a plurality of star rollers 10 which face the delivery roller 43 and are rotated by following the rotation of the delivery roller 43 when the paper sheet 2 intervenes between them, and so on. The delivery roller 43 and the star rollers 10 are provided at a downstream position from an image forming portion 40 facing the ink-jet head 9 in the paper feeding direction, which is illustrated by one-dotted chain line in FIG. 1. The star rollers 10 are fitted to a shaft 44 provided in parallel with the delivery roller 43 at a predetermined interval. Each star roller 10 is positioned in an axial direction of the shaft 44 by washers, which are engaged with the shaft 44 at positions adjoining both ends of the star roller 10.

The carriage driving mechanism 6 is constituted by a main shaft 51 which is held in the main scanning direction for guiding the motion of the carriage 5, a motor 61 for driving the carriage 5, a driving pulley 62 fixed on a driving shaft of the motor 61, a driven pulley 63, a timing belt 64 stretched between the driving pulley 62 and the driven pulley 63 in the main scanning direction, and so on. A maintenance unit 52 for carrying out maintenance of the ink-jet head 9 when a nozzle of the ink-jet head 9 has been clogged is provided at a position facing the carriage 5 at an end of the timing belt 64 in the main scanning direction.

As mentioned above, the ink-jet head 9 is build into part of the ink cartridge 7, and deposits a drop of a liquid ink toward the paper sheet 2 in correspondence with predetermined control signals. The carriage 5 further comprises a cradle 53 for holding the ink cartridge 7 and electric contacts (not shown) for transmitting the control signals to the ink-jet head 9, and so on.

The controller 8 is constituted by, for example, a CPU, a ROM and a RAM or an ASIC (application specific integrated circuit) that is integrated by the functions of these components. The controller 8 controls the paper feed mechanism 4, carriage driving mechanism 6 and the ink-jet head 9 using image data transmitted from an external apparatus such as a personal computer. At first, the controller 8 drives the paper feed mechanism 4 for conveying the paper sheet 2 at a constant speed in the paper feeding direction. Subsequently, the controller 8 drives the carriage driving mechanism 6 for moving the carriage 5 reciprocally in a predetermined area in the main scanning direction when the paper sheet 2 reaches the image forming portion 40. By controlling the paper feed mechanism 4 and the carriage driving mechanism 6, the inkjet head 9 on the carriage 5 can be relatively moved from a front end to a rear end of the paper sheet 2 in parallel with each line. Furthermore, the controller 8 controls the ink-jet head 9 corresponding to the image data in a manner so that drops of black ink are deposited on positions on a surface of the paper sheet where the image data shows "black" so as to apply the black ink. Alternatively, the controller 8 controls the ink-jet head 9 in a manner so that the drop of black ink is not deposited on positions where the image data shows "white" so as not to apply the black ink. The same goes for the other colored inks. In this way, an image is formed on the surface of the paper sheet 2 owing to applying or not applying drops of predetermined colored inks to predetermined positions on the paper sheet 2 corresponding to the image data.

Figure 2A:
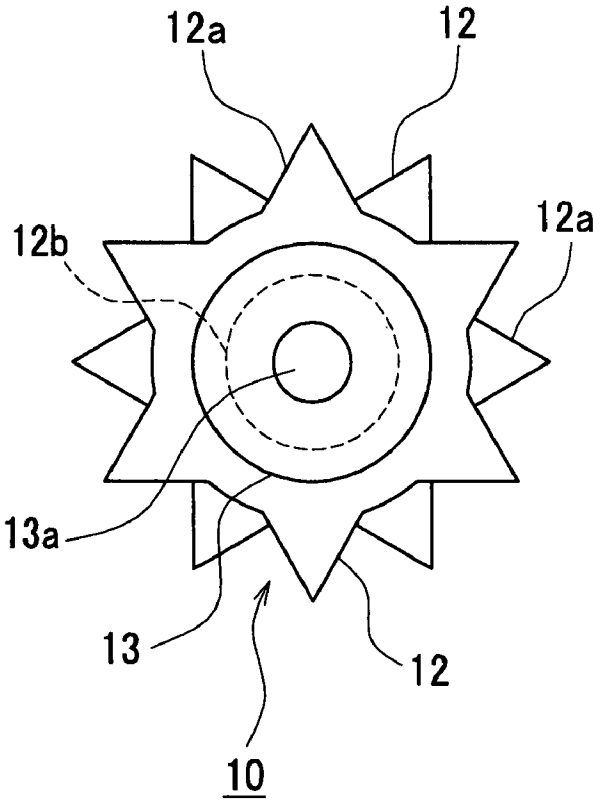
FIG. 2A is a left side view showing a configuration of a star roller used in a printer in accordance with an embodiment of the present invention.
Figure 2B:
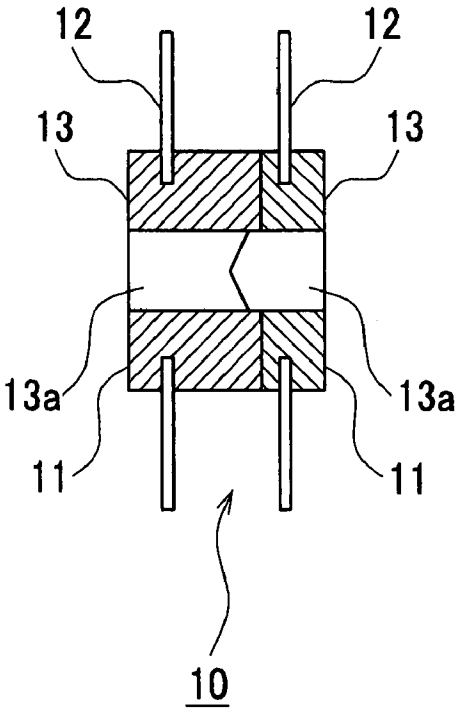
FIG. 2B is a front sectional view of the star roller.
Figure 2C:
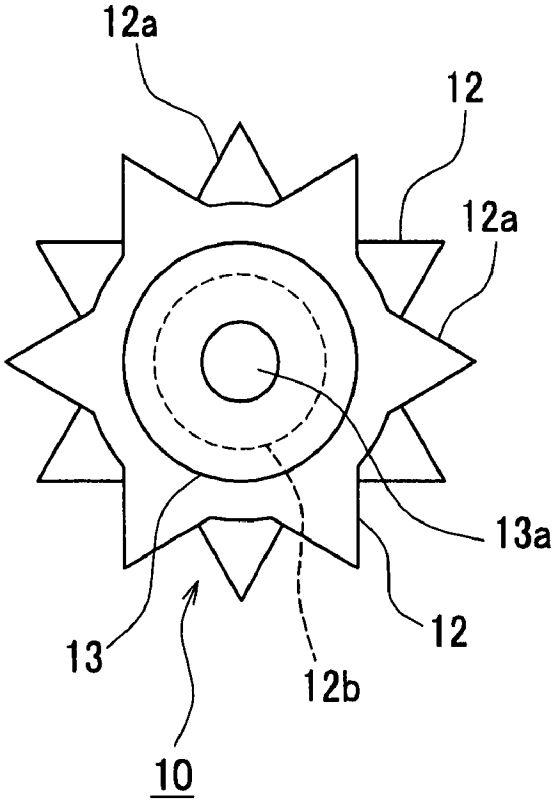
FIG. 2C is a right side view of the star roller.
Figure 3E:
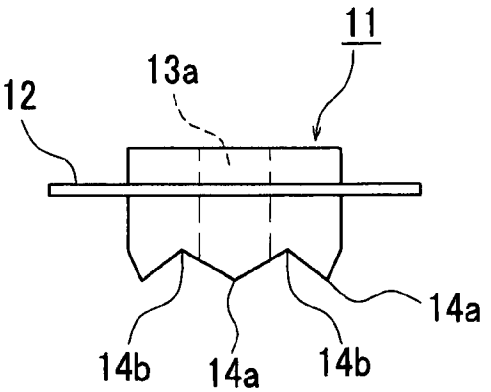
FIG. 3E is a plan view of the star roller unit.
Figure 3C:
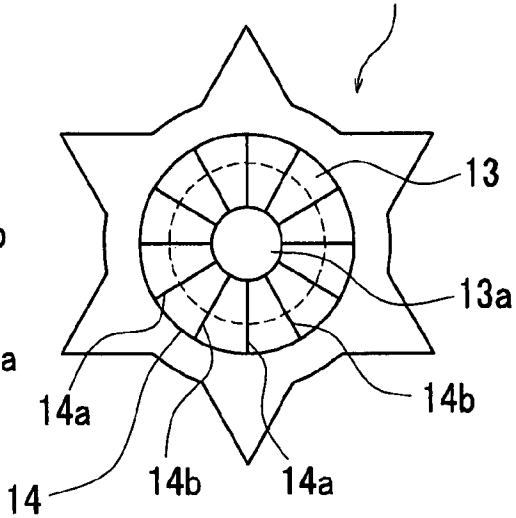
FIG. 3C is a right side view of the star roller unit.
Figure 3B:
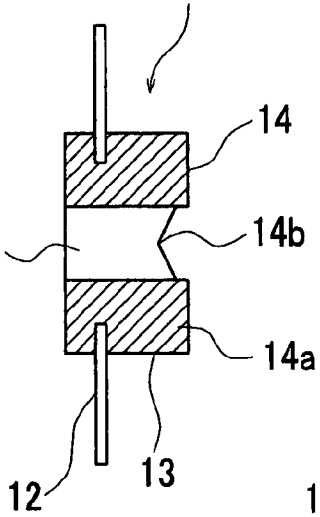
FIG. 3B is a front sectional view of the star roller unit.
Figure 3A:
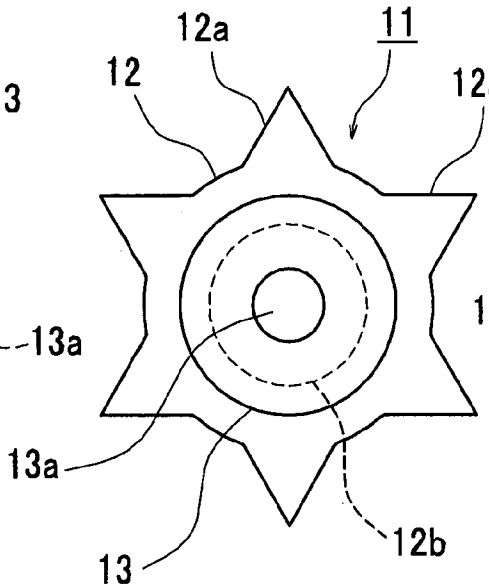
FIG. 3A is a left side view showing a configuration of a star roller unit constituting the star roller in accordance with the embodiment.
Figure 3D:
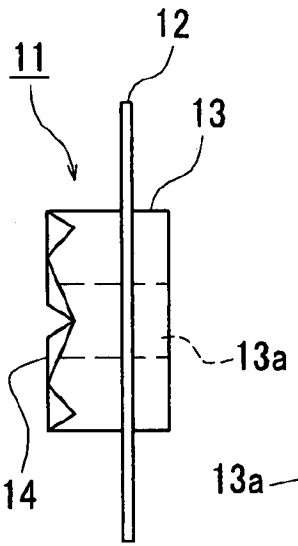
FIG. 3D is a rear view of the star roller unit.

Subsequently, a detailed configuration of the star roller 10 is described. An entire configuration of the star roller 10 is shown in FIGS. 2A to 2C. FIGS. 2A to 2C are respectively a left side view, a front sectional view and a right side view of the star roller 10. As can be seen from FIGS. 2A to 2C, the star roller 10 is constituted by a combination of two star roller units 11. The star roller units 11 are the same as each other, and one star roller unit 11 is reversed with respect to the other so as to be coupled.

Detailed configuration of the star roller unit 11 is shown in FIGS. 3A to 3E. FIGS. 3A to 3E are respectively a left side view, a front sectional view, a right side view, a rear view and a plan view of the star roller unit 11. The star roller unit 11 comprises one star wheel 12, in which a plurality of contacting portions 12*a* are provided in a radial pattern at a predetermined angular pitch, and a bearing portion 13 integrally formed with the star wheel 12 by an outsert molding.

The star wheel 12 is made of a metal plate such as SUS having a thickness of about 0.1 mm by press working. In this embodiment, six contacting portions 12*a* are provided at an angular pitch of 60 degrees. A top end of each contacting portion 12*a* forms an acute angle of about 60 degrees. An opening 12*b* having a diameter larger than a diameter of a bearing 13*a* of the bearing unit 13, but smaller than an outer diameter of the bearing portion 13, is formed at a center of the star wheel 12. When the bearing portion 13 is molded, melted resin flows to both sides of the star wheel 12 through the opening 12*b*, so that the star wheel 12 and the bearing portion 13 are integrated after the resin is hardened.

The bearing portion 13 has an axis perpendicular to a flat face of the star wheel 12. The bearing portion 13 further has a convex and concave structure 14 on an end face thereof in parallel with the flat face of the star wheel 12, which is used for coupling with another star roller unit 11. The convex and concave structure 14 is constituted by a plurality of convex portions 14*a* having the same pitch and phase as those of the contacting portions 12*a* of the star wheel 12, and a plurality of concave portions 14*b* having the same pitch as that of the contacting portions 12*a* of the star wheel 12 and a phase discrepant by a half period with respect to the phase of the convex portions 14*a* so that the convex portions 14*a* can be engaged with the concave portions 14*b*. In this embodiment, V-shaped grooves are continuously formed on an end face of the bearing portion 13 around the axis thereof. Consequently, peaks (convex portions 14*a*) and troughs (concave portions 14*b*) are respectively formed at the same pitch as, but discrepant by a half period with, each other. The phase of the peaks (convex portions 14*a*) coincides with that of the contacting portions 12*a* of the star wheel 12. A shape of the other end face of the bearing portion 13 is not limited, so that it is possible to be flat as illustrated in the figures.

Two star wheel units 11, which are as illustrated in FIGS. 3A to 3E, are prepared. One star wheel unit 11 is reversed with respect to the other in a manner so that the convex portions 14*a* of one star wheel unit 11 respectively face the concave portions 14*b* of the other. When the convex portions 14*a* of one star wheel unit 11 are engaged with the concave portions 14*b* of the other, the star roller 10 is completed as illustrated in FIGS. 2A to 2C. Since the phase of the convex portions 14*a* and the contacting portions 12*a* of the star wheel 12 perfectly coincide with each other, the phase of the contacting portions 12*a* of one star wheel 12 is discrepant by a half period with respect to the phase of the contacting portions 12*a* of the other star wheel 12 in the completed star roller 10. Two star roller units 11 are not necessarily fixed. A minute gap can be admitted between the star roller units 11, by which the star roller units 11 are not departed completely, when the star rollers 10 are fitted to the shaft 44 of the ink-jet printer 1.

Since the star roller 10 is constituted by two star roller units 11 of the same shape in combination with one reversed with respect to the other, and the phase of the contacting portions 12*a* of one star wheel 12 is discrepant by a half period with respect to the phase of the contacting portions 12*a* of the other star wheel 12, the star roller 10 is substantially equivalent to having a hypothetical star wheel with contacting portions at a half pitch of the contacting portions 12*a* of the star wheel 12. Thus, vibrations of the paper sheet 2 due to contact and non-contact of the star roller 10 can be reduced, so that the conveying speed of the paper sheet 2 in the image forming portion 40 can be made substantially constant. Consequently, the quality of the image formed on the surface of the paper sheet 2 is rarely damaged due to the vibrations of the paper sheet 2.

Furthermore, since the star wheel 12 is made of a metal plate by press working, the thickness of the contacting portions 12*a* in an axial direction of the rotation of the star roller 10 can be made thinner and the top end of each contacting portion 12*a* in a tangential direction of the star wheel 12 can be shaped acutely in comparison with those of the first conventional star roller in which the star wheel is integrally formed with the bearing portion by resin molding. Thus, a contacting dimension of each contacting portion 12*a* of the star wheel 12 with the surface of the paper sheet 2 can be made smaller. Consequently, it is possible to decrease the possibility of the occurrence of ink bolts due to reattachment of the ink attached on the contacting portion 12*a* of the star wheel 12 at another portion on the surface of the paper sheet 2, even when the star roller 10 is used in the paper feed mechanism 4 of the ink-jet printer 1 and drying of the ink applied on the surface of the paper sheet 2 is incomplete.

Figure 4A:
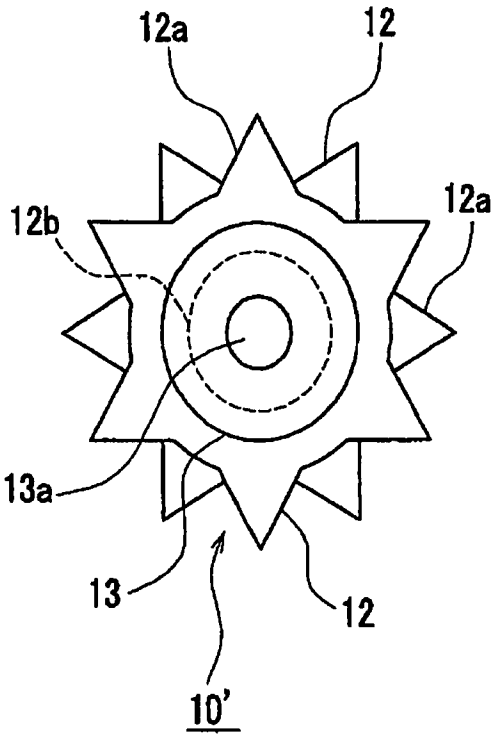
PRIOR ART FIG. 4A
FIG. 4A is a left side view showing a constitution of a conventional star roller in which two star wheels are integrally fixed on a bearing portion by outsert molding.
Figure 4B:
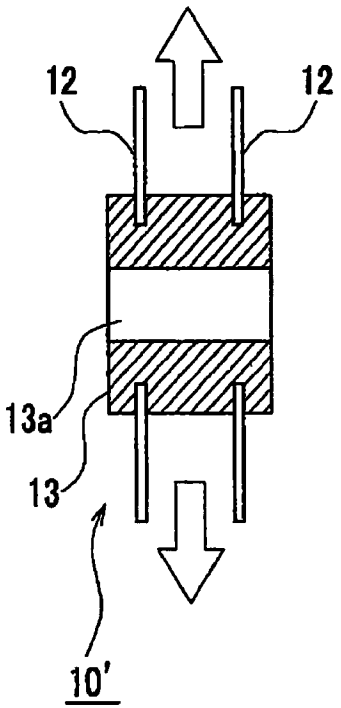
PRIOR ART FIG. 4B
FIG. 4B is a front sectional view of the conventional star roller.
Figure 4C:
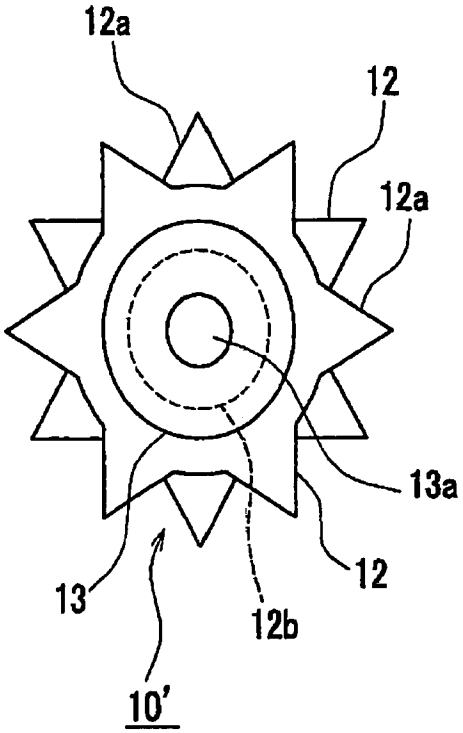
PRIOR ART FIG. 4C
FIG. 4C is a right side view of the conventional star roller.

Still furthermore, since only one star wheel 12 can be inserted in each star roller unit 11, the star roller unit 11 can be molded by resin without using a slide core in the die and a mechanism for moving the slide core. A reference star roller 10' having the same shape as the star roller 10, in which two star wheels 12 are integrally outserted with the bearing portion 13, is shown in FIGS. 4A to 4C for reference. FIGS. 4A to 4C are respectively a rear side view, a front sectional view and a right side view of the star roller 10'. In order to mold the reference star roller 10' with outserting two star wheels 12, a slide core is necessary for holding two star wheels 12 and for preventing the flow of the resin between two star wheels 12, similar to the second conventional star roller. Furthermore, the slide core must be pulled out in a direction shown by arrows in FIG. 4B. Even when it is tried to mold a plurality of the reference star rollers 10' in the same die in one molding operation, recesses for forming the reference star rollers 10' must be aligned on only one line in a direction perpendicular to the paper sheet of FIG. 4B.

On the contrary, in the star roller unit 11 in accordance with the embodiment, only one star wheel 12 is outserted, so that there is no need to use the slide core in the die. Thus, a generic die can be used for molding the star roller unit 11. Furthermore, recesses for forming the star roller units 11 can be aligned two-dimensionally not only in a direction perpendicular to the paper sheet of FIG. 3B, but also in a direction parallel to the paper sheet. Consequently, the star roller units 11 can be molded on a plurality of lines in the same die in one molding operation, so that a number of the star roller units 11 formed in one molding operation can be increased drastically. A unit cost of the star roller unit 11 can be made very inexpensive. Furthermore, the star roller 10 is constituted by two of the same star roller units 11, so that the cost of the star roller 10 can be made very inexpensive. Still furthermore, the cost of the inkjet printer 1 using a plurality of the star rollers 10 can be reduced.

In the above-mentioned description of the embodiment, the V-shaped grooves are continuously formed on an end face of the bearing portion 13 as the convex and concave structure 14. The present invention, however, is not limited by the description of the embodiment. It is sufficient that the star roller 10, in which the phase of the contacting portions 12*a* of one star wheel 12 is discrepant by a half period with respect to the phase of the contacting portion 12*a* of the other star wheel 12, can be constituted by the combination of two star roller units 11 having the sane shape. Thus, the convex and concave structure 14 can take another sectional shape in which convex portion(s) and concave portion(s) are alternately formed. The number of the convex and concave portions need not necessarily be more than two. It is possible that the convex and concave structure 14 is constituted by only one convex portion and one concave portion, which can be engaged with each other.

Still furthermore, one of the star roller units 11 is not necessarily reversed. It is possible to align two star roller units 11 having the same shape in the same direction. In such case, two convex and concave structures 14 are provided on both end faces of the bearing portion 13 in a manner so that the phase of the convex portions 14*a* of one convex and concave structure 14 coincides with that of the other convex and concave structure 14.

Still furthermore, in the above-mentioned embodiment, the star roller is used in the paper feed mechanism of the ink-jet printer. The star roller, however, can also be used in a paper feed mechanism of another type of printer such as a laser beam printer or a sublimatic printer.

This application is based on Japanese patent application 2003-337393 filed Sep. 29, 2003 in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. An ink-jet printer comprising: a paper feed tray; a paper feed mechanism for conveying a paper sheet in a predetermined paper feeding direction; a carriage facing a predetermined position in the paper feed mechanism and being reciprocally movable in a main scanning direction perpendicular to the paper feeding direction; a carriage driving mechanism for moving the carriage reciprocally in the main scanning direction; an ink-jet head held on the carriage; and a controller for controlling the paper feed mechanism, the carriage driving mechanism and the ink-jet head for forming an image on a surface of the paper sheet using image data; wherein the paper feed mechanism further comprises a delivery roller and a plurality of star rollers facing the delivery roller and being rotated by following the rotation of the delivery roller when the paper sheet intervenes between them, the delivery roller and the plurality of star rollers being provided at a downstream position from an image forming portion facing the ink-jet head in the paper feeding direction;

each star roller is constituted by a combination of two star roller units having the same shape; and each star roller unit further comprises:

a star wheel made of a metal plate by press working, in which a plurality of contacting portions are provided in a radial pattern at a predetermined angular pitch;

a bearing portion integrally formed with the star wheel by an outsert molding; and a convex and concave structure formed on at least an end face of the bearing portion in which a plurality of convex portions have the same pitch and phase as those of the contacting portions of the star wheel, and in which a plurality of concave portions have the same pitch as that of the contacting portions of the star wheel and a phase discrepant by half with respect to the phase of the convex portions so that the convex portions of one star roller unit are engageable with the concave portions of the other star roller unit.

2. The ink-jet printer in accordance with claim 1, wherein one convex and concave structure is formed on one end face of the bearing portion; and the star roller is constituted by the combination of two star roller units in a manner so that one star roller unit is reversed with respect to the other star roller unit, in which the concave portions of the convex and concave structure of the one star roller unit engages with the convex portions of the convex and concave structure of the other star roller unit.

3. The ink-jet printer in accordance with claim 1, wherein two convex and concave structures are formed on both end faces of the bearing portion; and the star roller is constituted by the combination of two star roller units in a manner so that two star roller units are arranged in the same direction, in which the concave portions of the convex and concave structure on an end face of the one star roller unit engage with the convex portions of the convex and concave structure on the other end face of the other star roller unit.

4. A star roller used in a paper feed mechanism of a printer constituted by a combination of two star roller units having the same shape, wherein each star roller unit further comprises:

a star wheel made of a metal plate by press working, in which a plurality of contacting portions are provided in a radial pattern at a predetermined angular pitch;

a bearing portion integrally formed with the star wheel by an outsert molding; and a convex and concave structure formed on at least an end face of the bearing portion, in which a plurality of convex portions have the same pitch and phase as those of the contacting portions of the star wheel, and in which a plurality of concave portions have the same pitch as that of the contacting portions of the star wheel and a phase discrepant by half with respect to the phase of the convex portions so that the convex portions of one star roller unit are engageable with the concave portions of another star roller unit.

5. The star roller in accordance with claim 4, wherein one convex and concave structure is formed on one end face of the bearing portion; and the star roller units are combined in a manner so that one star roller unit is reversed with respect to the other star roller unit, in which the concave portions of the convex and concave structure of the one star roller unit engage with the convex portions of the convex and concave structure of the other star roller unit.

6. The star roller in accordance with claim 4, wherein two convex and concave structures are formed on both end faces of the bearing portion; and the star roller units are combined in a manner so that two star roller units are arranged in the same direction, in which the concave portions of the convex and concave structure on an end face of the one star roller unit engage with the convex portions of the convex and concave structure on the other end face of the other star roller unit.

7. A star roller unit for constituting a star roller unit used in a paper feed mechanism of a printer comprising:

a star wheel made of a metal plate by press working, in which a plurality of contacting portions are provided in a radial pattern at a predetermined angular pitch;

a bearing portion integrally formed with the star wheel by an outsert molding; and a convex and concave structure formed on at least an end face of the bearing portion, in which a plurality of convex portions have the same pitch and phase as those of the contacting portions of the star wheel, and in which a plurality of concave portions have the same pitch as that of the contacting portions of the star wheel and a phase discrepant by half with respect to the phase of the convex portions BO that the convex portions are engageable with concave portions of an associated star wheel.

* * * * *